US011037510B2

(12) United States Patent
Wang et al.

(10) Patent No.: US 11,037,510 B2
(45) Date of Patent: Jun. 15, 2021

(54) PIXEL DRIVING SYSTEM FOR AMOLED DISPLAY DEVICE AND DRIVING METHOD

(71) Applicant: Shenzhen China Star Optoelectronics Semiconductor Display Technology Co., Ltd., Shenzhen (CN)

(72) Inventors: Shan Wang, Shenzhen (CN); Yichien Wen, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 395 days.

(21) Appl. No.: 16/098,865

(22) PCT Filed: Sep. 19, 2018

(86) PCT No.: PCT/CN2018/106575
§ 371 (c)(1),
(2) Date: Nov. 5, 2018

(87) PCT Pub. No.: WO2019/205470
PCT Pub. Date: Oct. 31, 2019

(65) Prior Publication Data

US 2021/0110775 A1 Apr. 15, 2021

(30) Foreign Application Priority Data

Apr. 23, 2018 (CN) ..... 201810369266.1

(51) Int. Cl.
*G09G 3/3291* (2016.01)
*G09G 5/10* (2006.01)
*G09G 3/3266* (2016.01)

(52) U.S. Cl.
CPC ..... *G09G 3/3291* (2013.01); *G09G 3/3266* (2013.01); *G09G 5/10* (2013.01);
(Continued)

(58) Field of Classification Search
CPC ..... G09G 3/3291; G09G 3/3266; G09G 5/10; G09G 2320/0633; G09G 2320/0673
See application file for complete search history.

(56) References Cited

U.S. PATENT DOCUMENTS

2008/0142827 A1* 6/2008 Choi ..... G09G 3/3233 257/98
2015/0154913 A1* 6/2015 Kim ..... G09G 3/3233 345/691
2016/0163258 A1 6/2016 Cho

FOREIGN PATENT DOCUMENTS

CN 101206825 A 6/2008
CN 103886833 A 6/2014
(Continued)

*Primary Examiner* — Amare Mengistu
*Assistant Examiner* — Jennifer L Zubajlo
(74) *Attorney, Agent, or Firm* — Leong C. Lei

(57) ABSTRACT

A pixel driving system for AMOLED display device and driving method are disclosed. The pixel driving system for AMOLED display device includes a sub-pixel driving circuit and a node voltage generating module electrically connected to the sub-pixel driving circuit. Wherein the node voltage generating module is inputted with the a red-green-blue display data for processing the red-green-blue display data, obtaining an APL value of a current frame of the AMOLED display device, and according to the APL value and a preset node voltage calculation formula, the node voltage generating module generates a corresponding node voltage and outputting to the source of the driving thin-film transistor. Adjusting the gate-to-source voltage of the driving thin-film transistor by using the APL value, thereby adjusting the driving current flowing through the light-
(Continued)

emitting diode to adjust the entire display brightness of the AMOLED display device.

9 Claims, 5 Drawing Sheets

(52) U.S. Cl.
CPC ..... *G09G 2320/0633* (2013.01); *G09G 2320/0673* (2013.01)

(56) References Cited

FOREIGN PATENT DOCUMENTS

| | | | |
|---|---|---|---|
| CN | 104700773 | A | 6/2015 |
| CN | 107452329 | A | 12/2017 |
| CN | 108538253 | A | 9/2018 |

* cited by examiner

PIXEL DRIVING SYSTEM FOR AMOLED DISPLAY DEVICE AND DRIVING METHOD

FIELD OF THE INVENTION

The present invention relates to a display technology field, and more particularly to a pixel driving system for AMOLED display device and driving method.

BACKGROUND OF THE INVENTION

The Organic Light Emitting Display (OLED) display device has advantages of self-luminous, low driving voltage, high luminous efficiency, short response time, high definition and contrast ratio, near 180° viewing angle, wide temperature range, and flexible display, and large-area full-color display such that the OLED has been recognized by the industry as the most promising display device.

The OLED display device can be divided into two types: a passive matrix OLED (PMOLED) and an active matrix OLED (AMOLED), that is, directly addressing and thin-film transistor (TFT) addressing. Wherein, the AMOLED has pixels arranged in an array, belongs to an active display type, has high luminous efficiency, and is generally used as a high-definition large-sized display device.

The AMOLED is a current driving device. When a current flows through the organic light-emitting diode, the organic light-emitting diode emits light, and the brightness of the light is determined by the current flowing through the organic light emitting diode itself. Most existing integrated circuit (IC) only transmits voltage signals, so the pixel driving circuit of AMOLED needs to complete the task of converting a voltage signal into a current signal. The conventional AMOLED pixel driving circuit is usually 2T1C, that is, a structure in which two thin-film transistors are added with a capacitor to convert a voltage into a current.

As shown in FIG. 1, a conventional 2T1C pixel driving circuit for an AMOLED includes a first thin-film transistor T10, a second thin-film transistor T20, a capacitor C10, and an organic light-emitting diode D10. The first thin-film transistor T10 is a switching thin-film transistor. The second thin-film transistor T20 is a driving thin-film transistor, and the capacitor C10 is a storage capacitor. Specifically, the gate of the first thin-film transistor T10 is connected to the scanning signal Gate, the source is connected to the data signal Data, and the drain is electrically connected to the gate of the second thin-film transistor T20 and one end of the capacitor C10.

The source of the second thin-film transistor T20 is connected to the power supply positive voltage OVDD, and the drain is electrically connected to the anode of the organic light-emitting diode D10. The cathode of the organic light-omitting diode D10 is connected to a power supply negative voltage OVSS. One end of the capacitor C10 is electrically connected to the drain of the first thin-film transistor T10, and the other end is electrically connected to the source of the second thin-film transistor T20. When displayed, the scanning signal Gate controls the first thin-film transistor T10 to be turned on, the data signal Data passes through the first thin-film transistor T10 to enter the gate of the second thin-film transistor T20 and the capacitor C10, and then the first thin-film transistor T10 is turned off due to the capacitance C10. For storage, the gate voltage of the second thin-film transistor T20 can continue to maintain the data signal voltage, so that the second thin-film transistor T20 is in an on state, and the driving current enters the organic light-emitting diode D10 through the second thin-film transistor T20 to drive the organic light-emitting diode D10 to emit a light.

When the pixel driving circuit shown in FIG. 1 is in operation, the organic light-emitting diode D10 is in a DC bias state for a long time, and the internal ion polarization thereof forms a built-in electric field, so that the threshold voltage of the organic light-omitting diode D10 is continuously increased, so that the threshold voltage of the organic light-emitting diode D10 is continuously increased. The emission brightness is gradually reduced, and the long-time illuminating also shortens the life of the OLED D10, and the aging of the OLED in different sub-pixels may cause uneven display of the screen, affecting the display effect.

In the prior art, the brightness of the picture is often adjusted by detecting and adjusting an average picture level (APL) of the OLED display to improve the display effect. The common method for adjusting the APL is to adjust the brightness of the grayscale level of the input data signal, adjust the power supply positive voltage or the power supply negative voltage. However, the algorithm for adjusting the APL and adjusting the brightness of the picture by adjusting the data signal is complicated, and the hardware resources occupied by adjusting the power supply positive voltage or the power supply negative voltage to adjust the APL and adjust the brightness of the picture are more.

SUMMARY OF THE INVENTION

An object of the present invention to provide a pixel driving system for an AMOLED display device capable of adjusting a driving current flowing through an organic light-emitting diode to adjust the brightness of the entire display picture.

Another object of the present invention is to provide a driving method for an AMOLED display device capable of adjusting a driving current flowing through an organic light-emitting diode to adjust the brightness of the entire display picture.

In order to achieve the above purpose, the present invention provides a pixel driving system for AMOLED display device, comprising a sub-pixel driving circuit and a node voltage generating module electrically connected to the sub-pixel driving circuit; wherein the sub-pixel driving circuit includes a first TFT, a second TFT, a third TFT, a capacitor, and an organic light-emitting diode; a gate of the first TFT is connected to a scanning signal, a source of the first TFT is connected to a data signal voltage, and a drain of the first TFT is electrically connected to a first node; a gate of the second TFT is electrically connected to the first node, a drain of the second TFT is connected to a power supply positive voltage, and a source of the second TFT is electrically connected to a second node; a gate of the third TFT is connected to the scanning signal, a source of the third TFT is electrically connected to the node voltage generating module, and a drain of the third TFT is electrically connected to a second node; two ends of the capacitor are respectively connected to the first node and the second node; an anode of the organic light-emitting diode is electrically connected to the second node, and a cathode of the organic light-emitting diode is connected to a power supply negative voltage; wherein the first TFT is one of an N-type TFT and a P-type TFT, and the third TFT is the same one of the N-type TFT and the P-type TFT as the first TFT; and wherein the node voltage generating module is inputted with the a red-green-blue display data for processing the red-green-blue display data, obtaining an APL value of a current frame of the AMOLED display device, and according to the APL value of the current frame of the AMOLED display device and a preset node voltage calculation formula, the node voltage generating module generates a corresponding node voltage and outputting to the second node.

Wherein the node voltage calculation formula is:

$$Vcm = \begin{cases} V\min, & APL < \text{APL_L} \\ \dfrac{V\max \times (APL - \text{APL_L})}{(\text{APL_H} - \text{APL_L})}, & \text{APL_L} \le APL \le \text{APL_H} \\ V\max, & APL > \text{APL_H} \end{cases}$$

wherein, Vcm is a node voltage, Vmin is a preset first voltage, Vmax is a preset second voltage, APL is the APL value of the current frame of the AMOLED display device, and APL_L is a preset first APL threshold, APL_H is a preset second APL threshold, the first voltage is less than the second voltage, and the first APL threshold is less than the second APL threshold.

Wherein the first voltage is 0V.

Wherein a difference value between the second voltage and the power supply negative voltage is less than a threshold voltage of the organic light-emitting diode.

Wherein the node voltage generating module includes a brightness feature value acquiring unit, a de-gamma unit, an APL acquiring unit, and a node voltage acquiring unit that are electrically connected in sequence; the brightness feature value obtaining unit is inputted with the red-green-blue display data for calculating an original brightness feature value of each pixel of the current frame of the AMOLED display device according to the red-green-blue display data and the preset brightness feature value calculation formula, and transmitting to the de-gamma unit; the de-gamma unit is configured to calculate a brightness feature value of each pixel of the current frame of the AMOLED display device after de-gamma according to the original brightness feature value of each pixel of the current frame of the AMOLED display device and a preset de-gamma formula, and transmitting to the APL acquiring unit; the APL acquiring unit is configured to calculate the APL value of the current frame of the AMOLED display according to the brightness feature value of each pixel of the current frame of the AMOLED display device after de-gamma and a preset average image voltage level calculation formula, and transmitting to the node voltage acquiring unit; and the node voltage acquiring unit is configured to calculate the node voltage according to the APL value of the current frame of the AMOLED display device and a preset node voltage calculation formula, and transmitting to the source of the third TFT.

Wherein the brightness feature value calculation formula is: Y=0.299R+0.589G+0.114B; wherein, Y is the original brightness feature value of the pixel, R is the grayscale value of a red subpixel of the pixel in the red-green-blue display data, and G is the grayscale value of a green subpixel of the pixel in the red-green-blue display data, and B is the grayscale value of a blue sub-pixel of the pixel in the red-green-blue display data.

Wherein the de-gamma formula is: $Y'=(Y/255)^{2.2}\times 255$; wherein Y' is the brightness feature value of the pixel after de-gamma.

Wherein the average image voltage level calculation formula is: APL=AverageY'/255×100; wherein, AverageY' is an average value of the brightness feature values of the current frame of the AMOLED display device after de-gamma.

Wherein the first TFT and the third TFT are both N-type TFTs.

The present invention also provides a driving method for an AMOLED display device, which is applied to the pixel driving system of the AMOLED display device as claimed in claim 1, comprising steps of: step S1, entering a data signal voltage storage stage, wherein a scanning signal controls a first TFT and a third TFT to be turned on, and a data signal voltage is written into a first node; a node voltage generating module obtains an APL value of a current frame of an AMOLED display device by processing a red-green-blue display data; the node voltage generating module generates a corresponding node voltage according to the APL value of the current frame of the AMOLED display device and a preset node voltage calculation formula, and outputting to a second node; step S2, entering the light-emitting display stage, wherein the scanning signal controls the first TFT and the third TFT to be turned off, due to the coupling effect of a capacitor, a voltage difference between the first node and the second node remains unchanged, a power supply positive voltage charges the second node, and the organic light-emitting diode emits a light.

The beneficial effects of the invention: the AMOLED display device of the present invention provides a pixel driving system for AMOLED display device, comprising a sub-pixel driving circuit and a node voltage generating module electrically connected to the sub-pixel driving circuit, the node voltage generating module is inputted with the a red-green-blue display data RGB, and electrically connected to the source of the driving thin-film transistor in the sub-pixel driving circuit, capable of processing the red-green-blue display data, obtaining the APL value of the current frame of the AMOLED display, and according to the APL value of the current frame of the AMOLED display and the preset node voltage calculation formula to generate a corresponding node voltage and outputs the voltage to the source of the driving thin-film transistor, and adjusts the gate-to-source voltage of the driving thin-film transistor by using the APL value, thereby adjusting the driving current flowing through the light-emitting diode in order to adjust the overall display brightness of the AMOLED display. The driving method of the AMOLED display of the present invention can adjust the driving current flowing through the organic light-emitting diode to adjust the brightness of the entire display screen.

BRIEF DESCRIPTION OF THE DRAWINGS

For a better understanding of the features and technical aspects of the present invention, reference should be made to the accompanying drawings. The drawings are provided for purposes of illustration and description only and are not intended for limiting.

In the drawings.

DETAILED DESCRIPTION OF PREFERRED EMBODIMENTS

In order to further clarify the technical means and effects of the present invention, the following detailed description will be made in conjunction with the preferred embodiments of the invention and the accompanying drawings.

Figure 1:
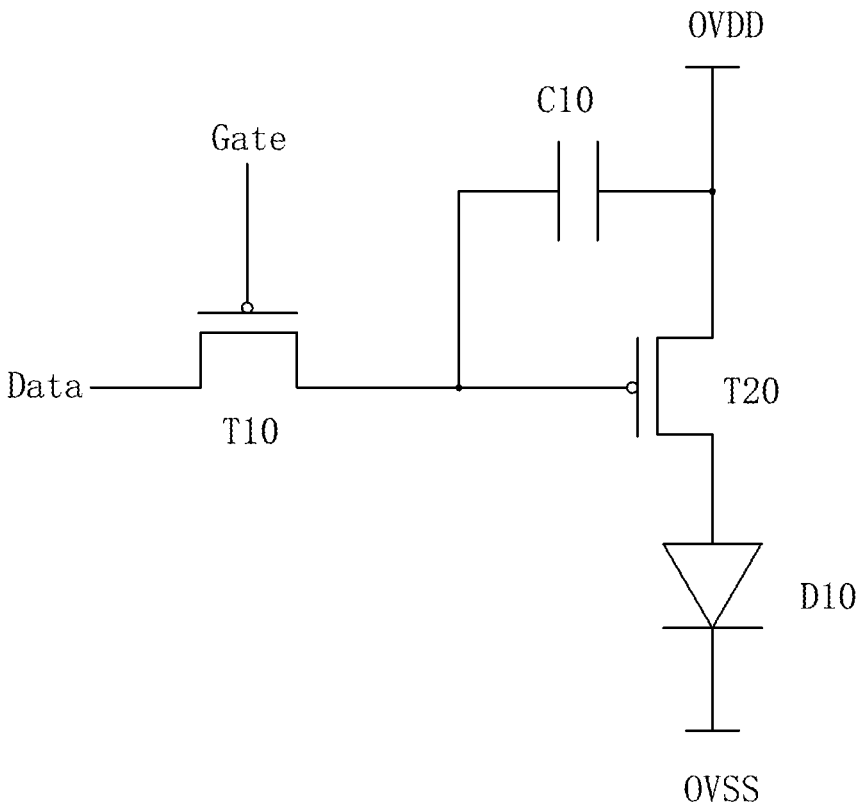
FIG. 1 is a conventional 2T1C pixel driving circuit for AMOLED.
Figure 2:
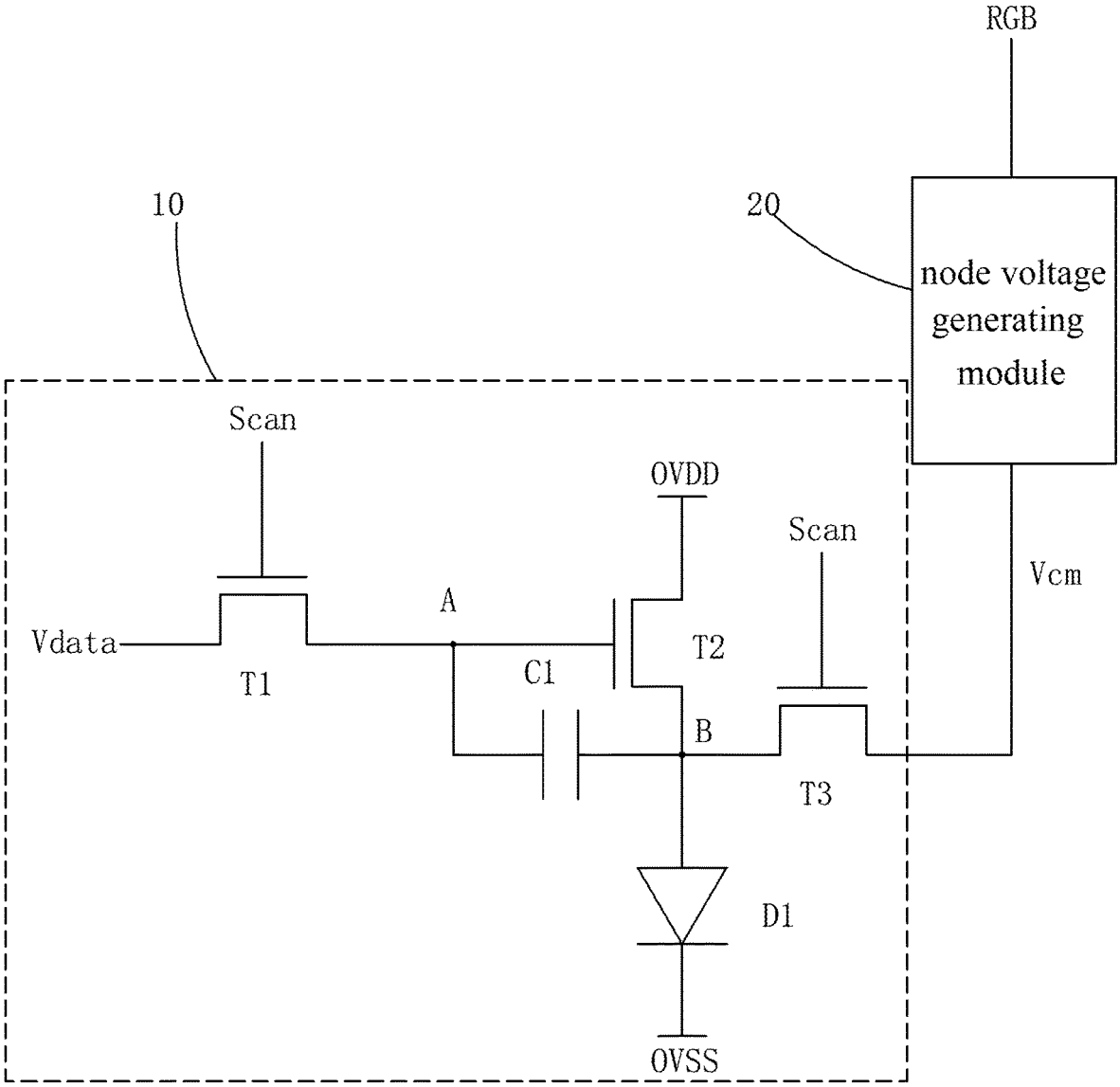
FIG. 2 is a schematic structural diagram of a pixel driving system of an AMOLED display device of the present invention.
Figure 3:
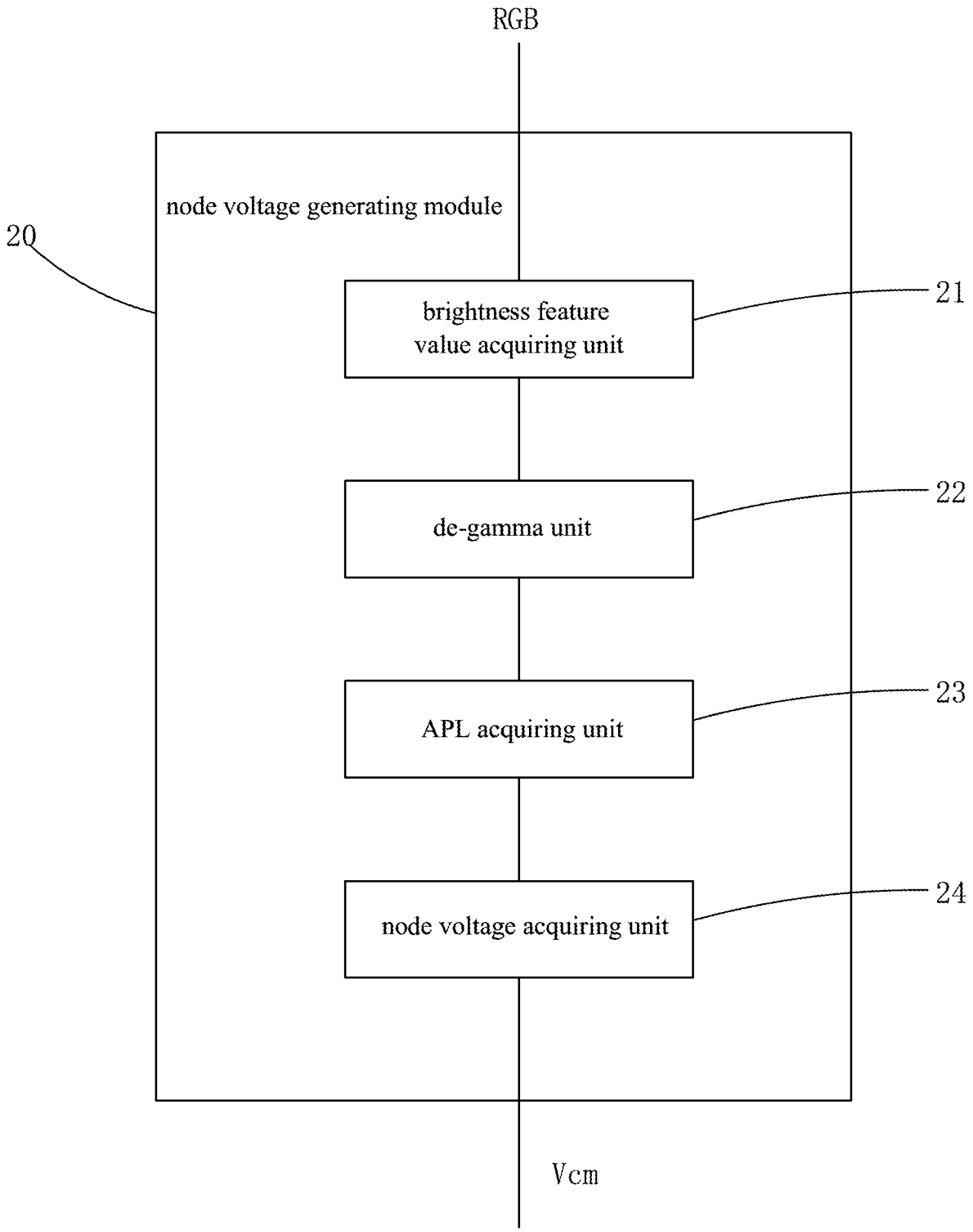
FIG. 3 is a schematic structural diagram of a node voltage generating module of a pixel driving system of an AMOLED display device of the present invention.
Figure 4:
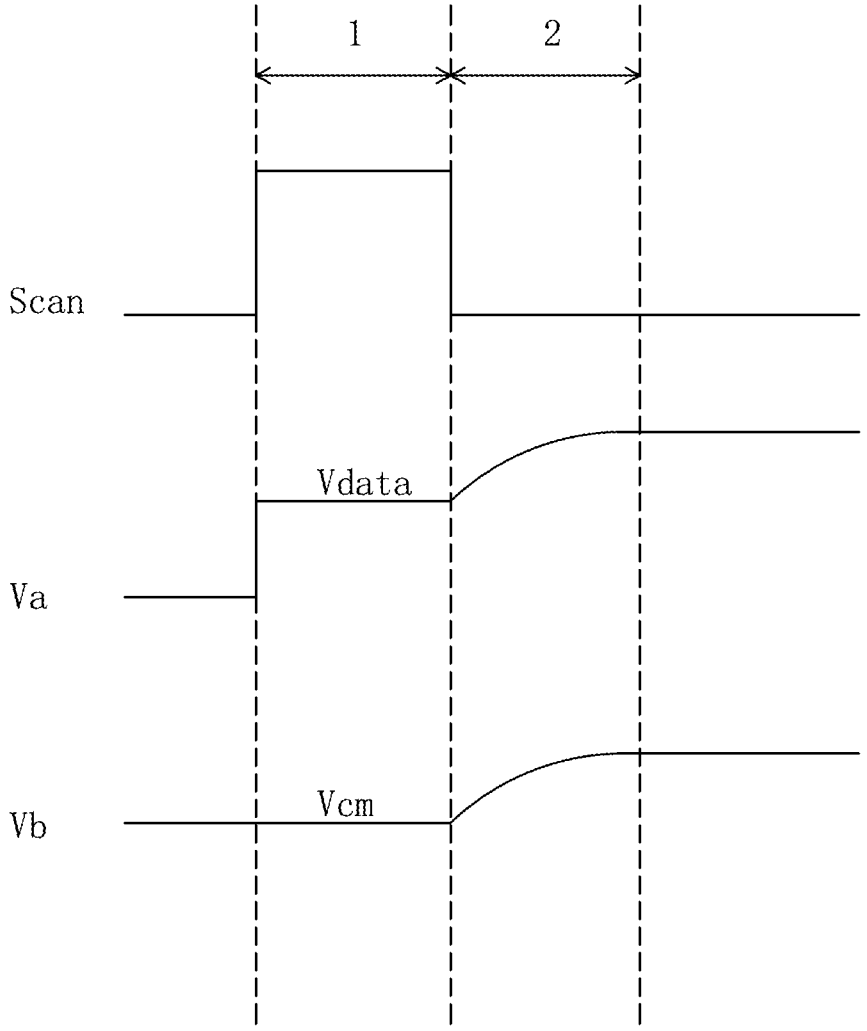
FIG. 4 is a timing chart showing the operation of the pixel driving system of the AMOLED display device of the present invention.

Referring to FIG. 2 to FIG. 4, the present invention provides a pixel driving system for AMOLED display device, comprising a sub-pixel driving circuit 10 and a node voltage generating module 20 electrically connected to the sub-pixel driving circuit 10.

The sub-pixel driving circuit 10 includes a first TFT T1, a second TFT T2, a third TFT T3, a capacitor C1, and an organic light-emitting diode D1. A gate of the first TFT T1 is connected to a scanning signal Scan, a source of the first TFT T1 is connected to a data signal voltage Vdata, and a drain of the first TFT T1 is electrically connected to a first node A. A gate of the second TFT T2 is electrically connected to the first node A, a drain of the second TFT T2 is connected to a power supply positive voltage OVDD, and a source of the second TFT T2 is electrically connected to a second node B. A gate of the third TFT T3 is connected to the scanning signal Scan, a source of the third TFT T3 is electrically connected to the node voltage generating module 20, and a drain of the third TFT T3 is electrically connected to a second node B. Two ends of the capacitor C1 are respectively connected to the first node A and the second node B. An anode of the organic light-emitting diode D1 is electrically connected to the second node B, and a cathode of the organic light-emitting diode D1 is connected to a power supply negative voltage OVSS. The first TFT T1 is one of an N-type TFT and a P-type TFT, and the third TFT T3 is the same one of the N-type TFT and the P-type TFT as the first TFT T1.

The node voltage generating module 20 is inputted with the a red-green-blue display data RGB for processing the red-green-blue display data RGB, obtaining an APL value of a current frame of the AMOLED display device, and according to the APL value of the current frame of the AMOLED display device and a preset node voltage calculation formula, the node voltage generating module 20 generates a corresponding node voltage Vcm and outputting to the second node B.

Specifically, the node voltage calculation formula is:

$$Vcm = \begin{cases} V\min, & APL < \text{APL_L} \\ \dfrac{V\max \times (APL - \text{APL_L})}{(\text{APL_H} - \text{APL_L})}, & \text{APL_L} \le APL \le \text{APL_H} \\ V\max, & APL > \text{APL_H} \end{cases}$$

Wherein, Vcm is a node voltage, Vmin is a preset first voltage, Vmax is a preset second voltage, APL is the APL value of the current frame of the AMOLED display device, and APL_L is a preset first APL threshold, APL_H is a preset second APL threshold, the first voltage is less than the second voltage, and the first APL threshold is less than the second APL threshold.

Specifically, referring to FIG. 3, the node voltage generating module 20 includes a brightness feature value acquiring unit 21, a de-gamma unit 22, an APL acquiring unit 23, and a node voltage acquiring unit 24 that are electrically connected in sequence. The brightness feature value obtaining unit 21 is inputted with the red-green-blue display data RGB for calculating an original brightness feature value of each pixel of the current frame of the AMOLED display device according to the red-green-blue display data RGB and the preset brightness feature value calculation formula, and transmitting to the de-gamma unit 22. The de-gamma unit 22 is configured to calculate a brightness feature value of each pixel of the current frame of the AMOLED display device after de-gamma according to the original brightness feature value of each pixel of the current frame of the AMOLED display device and a preset de-gamma formula, and transmitting to the APL acquiring unit 23.

The APL acquiring unit 23 is configured to calculate the APL value of the current frame of the AMOLED display according to the brightness feature value of each pixel of the current frame of the AMOLED display device after de-gamma and a preset average image voltage level calculation formula, and transmitting to the node voltage acquiring unit 24. The node voltage acquiring unit 24 is configured to calculate the node voltage Vcm according to the APL value of the current frame of the AMOLED display device and a preset node voltage calculation formula, and transmitting to the source of the third TFT T3.

Further, the brightness feature value calculation formula $Y=0.299R+0.589G+0.114B$;

Wherein, Y is the original brightness feature value of the pixel, R is the grayscale value of a red subpixel of the pixel in the red-green-blue display data RGB, and G is the grayscale value of a green subpixel of the pixel in the red-green-blue display data RGB, and B is the grayscale value of a blue sub-pixel of the pixel in the red-green-blue display data RGB.

The de-gamma formula is: $Y'=(Y/255)^{2.2}\times 255$;

Wherein Y' is the brightness feature value of the pixel after de-gamma.

The average image voltage level calculation formula is: $APL=AverageY'/255\times 100$;

Wherein, AverageY' is an average value of the brightness feature values of the current frame of the AMOLED display device after de-gamma.

Specifically, in the embodiment shown in AG. 2, the first TFT T1 and the third TFT T3 are both N-type TFTs.

Preferably, the first voltage is 0V.

Preferably, a difference value between the second voltage and the power supply negative voltage OVSS is less than a threshold voltage of the organic light-emitting diode D1.

Referring to the embodiment shown in FIG. 2 to FIG. 4, the operation process of the pixel driving system of the AMOLED display device of the present invention is as follows:

First, entering a data signal voltage storage stage 1. The scanning signal Scan is at a high voltage level, and controlling the first TFT T1 and the third TFT T3 to be turned on, and the data signal voltage Vdata is written into the first node A. At the same time, the node voltage generating module 20 obtains the APL value of the current frame of the AMOLED display by using the internal brightness feature value acquiring unit 21, the de-gamma unit 22, and the APL acquiring unit 23 to process the red-green-blue display data RGB. Besides, the node voltage generating module 20 generates a corresponding node voltage Vcm by using the internal node voltage obtaining unit 24 and according to the APL value of the current frame of the AMOLED display device and the preset node voltage calculation formula, and outputting to the second node B. At this time, the first node A, that is, the voltage value Va at one end of the capacitor C1 is Vdata, the second node B, that is, the voltage value Vb at the other end of the capacitor C1 is Vcm, and the gate-to-source voltage of the second TFT T2 is Vdata-Vcm.

After that, entering the light-emitting display stage 2. The scanning signal Scan is at a low voltage level, and the first TFT T1 and the third TFT T3 are controlled to be turned off. Due to the coupling effect of the capacitor C1, the voltage difference between the first node A and the second node B remains unchanged, and is still Vdata-Vcm. The power supply positive voltage OVDD charges the second node B, so that the voltage Vb of the second node B and the voltage Va of the first node A continuously increase. When the voltage Vb of the second node B rises to a voltage value such that a difference between the voltage Vb and the power source negative voltage OVSS is greater than the threshold voltage of the organic light-emitting diode D1, the organic light-emitting diode D1 emits light. According to a formula for the current flowing through an organic light-emitting diode in the prior art:

$$I=K(Vgs-Vth)^2;$$

Wherein, I is the current flowing through the organic light-emitting diode D1, K is the structural parameter of the driving thin-film transistor, that is, the second TFT T2, and Vgs is the gate-to-source voltage of the driving thin-film transistor, that is, the second TFT T2, and Vth is the threshold voltage of the second TFT T2. Due to the storage function of the capacitor C1, the gate-to-source voltage of the second TFT T2 is always Vdata-Vcm in the light-emitting display stage 2, and thus the current I flowing through the organic light-omitting diode D1 at this time is $I=K(Vgs-Vth)^2=K(Vdata-Vcm-Vth)^2$.

It should be noted that, in the present invention, the node voltage generating module 20 is used to obtain the APL value of the current frame of the AMOLED display device, and the APL value of the current frame of the AMOLED display is substituted into the calculation formula according to the preset node voltage. And substituting the APL value of the current frame into the preset node voltage calculation formula, calculating the corresponding node voltage Vcm and inputting the second node B. Through the change of the APL value, the change of the node voltage Vcm can be controlled correspondingly so that the value of the gate-to-source voltage of the driving thin-film transistor, that is, the second TFT T2 can be controlled. The current value flowing through the second TFT T2 and the organic light-emitting diode D1 is further controlled to achieve the purpose of controlling the display brightness of the AMOLED display.

Specifically, when the APL value is greater than the preset second APL threshold, it indicates that the APL value of the current frame of the AMOLED display is too large, and the brightness of the display panel of the AMOLED display requires to be adjusted in a maximum degree. At this time, the node voltage generating module 20 generates a second voltage having a larger voltage value as the node voltage Vcm and outputs it to the second node B of the sub-pixel driving circuit 10 such that the gate-to-source voltage of the second TFT T2 stored in the capacitor C1 is small. Therefore, in the light-emitting display stage 2, the current value flowing through the organic light-emitting diode becomes smaller, so that the display brightness of the AMOLED display becomes lower. When the APL value is smaller than the preset first APL threshold, It indicates that the APL value of the current frame of the AMOLED display device is small, and there is no need to adjust the picture brightness of the AMOLED display device. Therefore, the node voltage generating module 20 generates the first voltage with a small voltage value or even 0 as the node voltage Vcm, and outputting to the second node of the sub-pixel driving 10 such that the gate-to-source voltage of the second TFT T2 stored in the capacitor C1 is close to the data signal voltage Vdata, so that in the light-emitting display stage 2, the current value flowing through the organic light-emitting diode can maximally close to a driving current value corresponding to the data signal voltage Vdata; When the APL value is greater than or equal to the preset first APL threshold and less than or equal to the preset second APL threshold, it indicates that the picture brightness of the AMOLED display device should be adjusted in a certain degree. At this time, the node voltage generating module 20 generates a voltage value that is between the first voltage and the second voltage and positively correlated with the APL value as a node voltage Vcm, and outputting the node voltage Vcm to the second node B of the sub-pixel driving circuit 10 such that when the APL value is larger, the gate-to-source voltage of the second TFT T2 stored in the capacitor C1 is smaller, when the current value flowing through the organic light-emitting diode is smaller in the light-emitting display stage 2, the brightness of the organic light-emitting diode D1 is lower.

In the above manner, the overall display brightness of the AMOLED display device can be effectively adjusted according to the APL value of the current frame of the AMOLED display device, and the display quality of the AMOLED display device can be improved, and at the same time, comparing to the prior art, no complicated algorithm is required and no need to occupy hardware resources to adjust the picture brightness, which can effectively improve the quality of the product.

Figure 5:
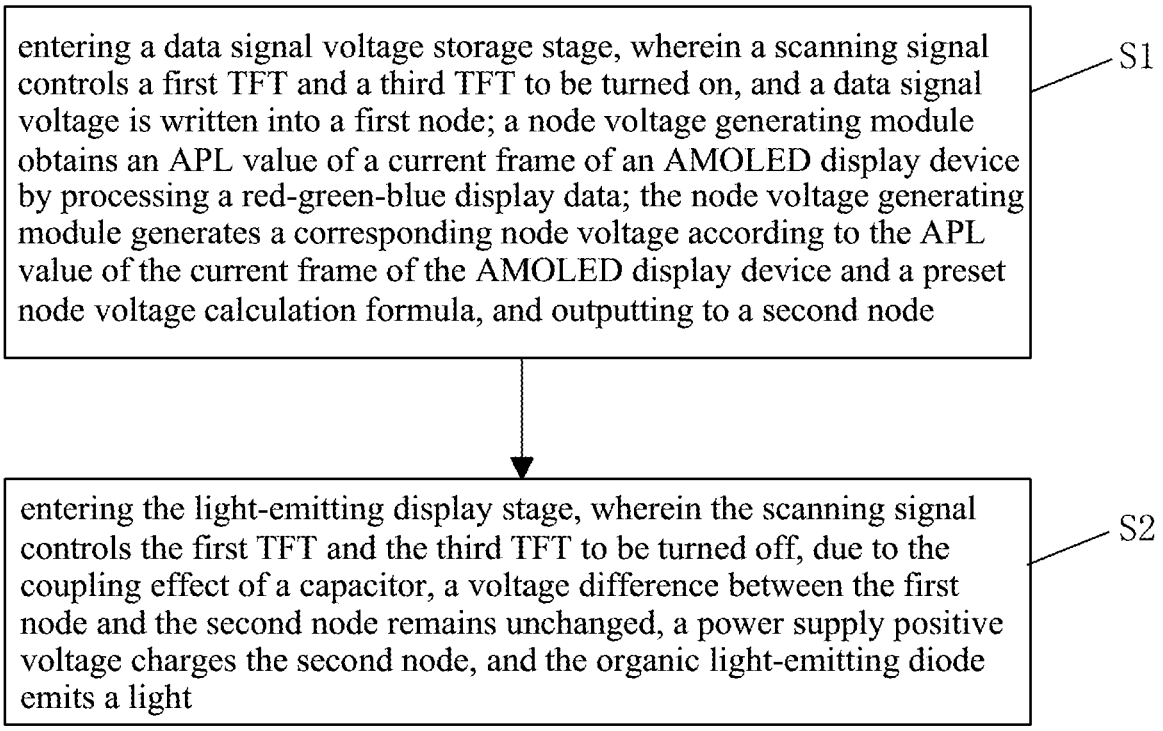
FIG. 5 is a flow chart of a driving method for an AMOLED display of the present invention.

Referring to FIG. 5, and in conjunction with FIG. 2 to AG. 4, based on the same inventive concept, the present invention further provides a driving method for an AMOLED display device, which is applied to the pixel driving system of the AMOLED display device described above, and includes the following steps:

Step S1, entering a data signal voltage storage stage 1. A scanning signal Scan controls a first TFT T1 and a third TFT T3 to be turned on, and a data signal voltage Vdata is written into a first node A. A node voltage generating module 20 obtains an APL value of a current frame of an AMOLED display device by processing a red-green-blue display data RGB. Besides, the node voltage generating module 20 generates a corresponding node voltage Vcm according to the APL value of the current frame of the AMOLED display device and a preset node voltage calculation formula, and outputting to a second node B.

Specifically, in the step S1, the node voltage generating module 20 obtains the APL value of the current frame of the AMOLED display device by using the internal brightness feature value acquiring unit 21, the de-gamma unit 22, and the APL acquiring unit 23 to process the red-green-blue display data RGB. Besides, the node voltage generating module 20 generates a corresponding node voltage Vcm by using the internal node voltage obtaining unit 24 and according to the APL value of the current frame of the AMOLED display device and the preset node voltage calculation formula, and outputting to the second node B. At this time, the first node A, that is, the voltage value Va at one end of the capacitor C1 is Vdata, the second node B, that is, the voltage value Vb at the other end of the capacitor C1 is Vcm, and the gate-to-source voltage of the second TFT T2 is Vdata-Vcm.

Specifically, in the embodiment shown in FIG. 2 to AG. 4, and in the step S1, the scanning signal Scan is at a high voltage level, controlling the first TFT T1 and the third TFT T3 to be turned on.

Step S2, entering the light-emitting display stage 2. The scanning signal Scan controls the first TFT T1 and the third TFT T3 to be turned off. Due to the coupling effect of a capacitor G1, a voltage difference between the first node A and the second node B remains unchanged. A power supply positive voltage OVDD charges the second node B, and the organic light-emitting diode D1 emits a light.

Specifically, in the step S2, due to the coupling effect of the capacitor C1, the voltage difference between the first node A and the second node B remains unchanged, and is still Vdata-Vcm. The power supply positive voltage OVDD charges the second node B, so that the voltage Vb of the second node B and the voltage Va of the first node A continuously increase. When the voltage Vb of the second node B rises to a voltage value such that a difference between the voltage Vb and the power supply negative voltage OVSS is greater than the threshold voltage of the organic light emitting diode D1, the organic light-emitting diode D1 emits light. According to a formula for the current flowing through an organic light-emitting diode in the prior art:

$$I=K(Vgs-Vth)^2;$$

Wherein, I is the current flowing through the organic light-emitting diode D1, K is the structural parameter of the driving thin-film transistor, that is, the second TFT T2, and Vgs is the gate-to-source voltage of the driving thin-film transistor, that is, the second TFT T2, and Vth is the threshold voltage of the second TFT T2. Due to the storage function of the capacitor C1, the gate-to-source voltage of the second TFT T2 is always Vdata−Vcm in the light-emitting display stage 2, and thus the current I flowing through the organic light-emitting diode D1 at this time is $I=K(Vgs-Vth)^2=K(Vdata-Vcm-Vth)^2$.

Specifically, in the embodiment shown in FIG. 2 to FIG. 4, in the step S2, the scanning signal Scan is at a low voltage level, and the first TFT T1 and the third TFT T3 are controlled to be turned off.

It should be noted that, in the present invention, the node voltage generating module 20 is used to obtain the APL value of the current frame of the AMOLED display, and the APL value of the current frame of the AMOLED display is substituted into the calculation formula according to the preset node voltage. And substituting the APL value of the current frame into the preset node voltage calculation formula, calculating the corresponding node voltage Vcm and inputting the second node B. Through the change of the APL value, the change of the node voltage Vcm can be controlled correspondingly so that the value of the gate-to-source voltage of the driving thin-film transistor, that is, the second TFT T2 can be controlled. The current value flowing through the second TFT T2 and the organic light-emitting diode D1 is further controlled to achieve the purpose of controlling the display brightness of the AMOLED display device.

Specifically, when the APL value is greater than the preset second APL threshold, it indicates that the APL value of the current frame of the AMOLED display is too large, and the brightness of the display panel of the AMOLED display requires to be adjusted in a maximum degree. At this time, the node voltage generating module 20 generates a second voltage having a larger voltage value as the node voltage Vcm and outputs it to the second node B of the sub-pixel driving circuit 10 such that the gate-to-source voltage of the second TFT T2 stored in the capacitor C1 is small. Therefore, in the light-emitting display stage 2, the current value flowing through the organic light-emitting diode becomes smaller, so that the display brightness of the AMOLED display device becomes lower. When the APL value is smaller than the preset first APL threshold. It indicates that the APL value of the current frame of the AMOLED display is small, and there is no need to adjust the picture brightness of the AMOLED display. Therefore, the node voltage generating module 20 generates the first voltage with a small voltage value or even 0 as the node voltage Vcm, and outputting to the second node of the sub-pixel driving 10 such that the gate-to-source voltage of the second TFT T2 stored in the capacitor C1 is close to the data signal voltage Vdata, so that in the light-emitting display stage 2, the current value flowing through the organic light-emitting diode can maximally close to a driving current value corresponding to the data signal voltage Vdata;

When the APL value is greater than or equal to the preset first APL threshold and less than or equal to the preset second APL threshold, it indicates that the picture brightness of the AMOLED display should be adjusted in a certain degree. At this time, the node voltage generating module 20 generates a voltage value that is between the first voltage and the second voltage and positively correlated with the APL value as a node voltage Vcm, and outputting the node voltage Vcm to the second node B of the sub-pixel driving circuit 10 such that when the APL value is larger, the gate-to-source voltage of the second TFT T2 stored in the capacitor C1 is smaller, when the current value flowing through the organic light-emitting diode is smaller in the light-emitting display stage 2, the brightness of the organic light-emitting diode D1 is lower.

In the above manner, the overall display brightness of the AMOLED display can be effectively adjusted according to the APL value of the current frame of the AMOLED display, and the display quality of the AMOLED display can be improved, and at the same time, comparing to the prior art, no complicated algorithm is required and no need to occupy hardware resources to adjust the picture brightness, which can effectively improve the quality of the product.

In summary, the AMOLED display device of the present invention provides a pixel driving system for AMOLED display device, comprising a sub-pixel driving circuit and a node voltage generating module electrically connected to the sub-pixel driving circuit, the node voltage generating module is inputted with the a red-green-blue display data RGB, and electrically connected to the source of the driving thin-film transistor in the sub-pixel driving circuit, capable of processing the red-green-blue display data, obtaining the APL value of the current frame of the AMOLED display, and according to the APL value of the current frame of the AMOLED display and the preset node voltage calculation formula to generate a corresponding node voltage and outputs the voltage to the source of the driving thin-film transistor, and adjusts the gate-to-source voltage of the driving thin-film transistor by using the APL value, thereby adjusting the driving current flowing through the light-emitting diode in order to adjust the overall display brightness of the AMOLED display. The driving method of the AMOLED display of the present invention can adjust the driving current flowing through the organic light-emitting diode to adjust the brightness of the entire display screen.

As described above, for those of ordinary skill in the art, various other changes and modifications can be made in accordance with the technical solutions and the technical concept of the present invention, and all such changes and modifications are intended to fall within the scope of the appended claims.

What is claimed is:

1. A pixel driving system for AMOLED display device, comprising:

a sub-pixel driving circuit electrically connected to the sub-pixel driving circuit;

wherein the sub-pixel driving circuit includes a first TFT, a second TFT, a third TFT, a capacitor, and an organic light-emitting diode; a gate of the first TFT is connected to a scanning signal, a source of the first TFT is connected to a data signal voltage, and a drain of the first TFT is electrically connected to a first node; a gate of the second TFT is electrically connected to the first node, a drain of the second TFT is connected to a power supply positive voltage, and a source of the second TFT is electrically connected to a second node; a gate of the third TFT is connected to the scanning signal, a source of the third TFT is electrically connected to a node voltage, and a drain of the third TFT is electrically connected to a second node; two ends of the capacitor are respectively connected to the first node and the second node; an anode of the organic light-emitting diode is electrically connected to the second node, and a cathode of the organic light-emitting diode is connected to a power supply negative voltage;

wherein the first TFT is one of an N-type TFT and a P-type TFT, and the third TFT is the same one of the N-type TFT and the P-type TFT as the first TFT; and wherein the node voltage that is fed to the source of the third TFT is determined by processing red-green-blue display data to obtain an APL value of a current frame of the AMOLED display device, and further processing the APL value of the current frame of the AMOLED display device according to a node voltage calculation formula to determine the node voltage that is fed to the second node by means of the third TFT; and wherein the node voltage calculation formula is as follows:

$$Vcm = \begin{cases} V\min, & APL < \text{APL_L} \\ \dfrac{V\max \times (APL - \text{APL_L})}{(\text{APL_H} - \text{APL_L})}, & \text{APL_L} \le APL \le \text{APL_H} \\ V\max, & APL > \text{APL_H} \end{cases}$$

wherein Vcm is a node voltage, Vmin is a preset first voltage, Vmax is a preset second voltage, APL is the APL value of the current frame of the AMOLED display device, and APL_L is a preset first APL threshold, APL_H is a preset second APL threshold, the first voltage is less than the second voltage, and the first APL threshold is less than the second APL threshold.

2. The pixel driving system for AMOLED display device according to claim 1, wherein the first voltage is 0V.

3. The pixel driving system for AMOLED display device according to claim 1, wherein a difference value between the second voltage and the power supply negative voltage is less than a threshold voltage of the organic light-emitting diode.

4. The pixel driving system for AMOLED display device according to claim 1, wherein the red-green-blue display data is first processed for calculating an original brightness feature value of each pixel of the current frame of the AMOLED display device according to a brightness feature value calculation formula;

the original brightness feature value of each pixel of the AMOLED display device to calculate a de-gamma brightness feature value of each pixel of the current frame of the AMOLED display device according to a de-gamma formula;

the de-gamma brightness feature value of each pixel of the current frame of the AMOLED display device is processed to calculate the APL value of the current frame of the AMOLED display device according to an average image voltage level calculation formula; and the APL value of the current frame of the AMOLED display device is processed to calculate the node voltage according to the node voltage calculation formula.

5. The pixel driving system for AMOLED display device according to claim 4, wherein the brightness feature value calculation formula is: Y=0.299R+0.589G+0.114B;

wherein, Y is the original brightness feature value of the pixel, R is the grayscale value of a red subpixel of the pixel in the red-green-blue display data, and G is the grayscale value of a green subpixel of the pixel in the red-green-blue display data, and B is the grayscale value of a blue sub-pixel of the pixel in the red-green-blue display data.

6. The pixel driving system for AMOLED display device according to claim 5, wherein the de-gamma formula is: $Y'=(Y/255)^{2.2}\times 255$;

wherein Y' is the de-gamma brightness feature value of the pixel.

7. The pixel driving system for AMOLED display device according to claim 6, wherein the average image voltage level calculation formula is: APL=AverageY'/255×100;

wherein, AverageY' is an average value of the de-gamma brightness feature values of the current frame of the AMOLED display device after de-gamma.

8. The pixel driving system for AMOLED display device according to claim 1, wherein the first TFT and the third TFT are both N-type TFTs.

9. A driving method for an AMOLED display device, which is applied to the pixel driving system of the AMOLED display device as claimed in claim 1, comprising steps of:

step S1, entering a data signal voltage storage stage, wherein a scanning signal controls a first TFT and a third TFT to be turned on, and a data signal voltage is written into a first node; an APL value of a current frame of an AMOLED display device is obtained by processing a red-green-blue display data; a node voltage is generated according to the APL value of the current frame of the AMOLED display device and a node voltage calculation formula, and outputting to a second node;

step S2, entering the light-emitting display stage, wherein the scanning signal controls the first TFT and the third TFT to be turned off, due to the coupling effect of a capacitor, a voltage difference between the first node and the second node remains unchanged, a power supply positive voltage charges the second node, and the organic light-emitting diode emits light.

* * * * *